United States Patent [19]

Kaneko

[11] Patent Number: 4,875,353

[45] Date of Patent: Oct. 24, 1989

[54] METHOD AND APPARATUS FOR MANUFACTURING CURVED PIPE

[75] Inventor: Toshio Kaneko, Kanagawa, Japan

[73] Assignee: Kabushiki Kaisha Asahi Kinzoku Kogyosho, Kawasaki, Japan

[21] Appl. No.: 265,487

[22] Filed: Nov. 1, 1988

[51] Int. Cl.[4] ..... B21D 7/08; B21D 9/12

[52] U.S. Cl. ..... 72/133; 72/134; 72/166; 72/369

[58] Field of Search ..... 29/157 A; 72/133, 134, 72/166, 169, 369, 426, 427

[56] References Cited

U.S. PATENT DOCUMENTS

| | | | |
|---|---|---|---|
| 4,352,281 | 10/1982 | Ragettli | 72/133 X |
| 4,759,206 | 7/1988 | Kaneko | 72/134 |

FOREIGN PATENT DOCUMENTS

| | | | |
|---|---|---|---|
| 251492 | 11/1962 | Australia | 72/133 |
| 51-75664 | 6/1976 | Japan | 72/133 |
| 53-146254 | 12/1978 | Japan | 72/166 |
| 58-202918 | 11/1983 | Japan | 72/133 |
| 897331 | 1/1982 | U.S.S.R. | 72/133 |

*Primary Examiner*—E. Michael Combs
*Attorney, Agent, or Firm*—Flynn, Thiel, Boutell & Tanis

[57] ABSTRACT

A curved pipe manufacturing method comprises the steps of: inserting a curved mandrel into a curved cavity of a fixed die having an entrance opening and an exit opening through the exit opening thereof, said cavity being formed in a circular arc and extending from the entrance opening to the exit opening thereof, said curved mandrel being attached to one side of a movable block; forming a curved pipe by pressing a work, with a presser rod through the entrance opening of the curved cavity into a curved space defined by the surface of the curved cavity and the mandrel; turning the movable block for extracting completely the curved pipe together with the mandrel from the exit opening of the curved cavity; inserting a retaining pin into a groove provided in the movable block for retaining a tip end of the curved pipe; and further turning the movable block so as to turn the mandrel while the curved pipe is separated from the mandrel. An apparatus for pipe is separated fro mthe mandrel. An apparatus for carrying out the curved pipe manufacturing method is also provided.

4 Claims, 5 Drawing Sheets

METHOD AND APPARATUS FOR MANUFACTURING CURVED PIPE

CROSS-REFERENCE TO RELATED APPLICATION

This application is related to U.S. Pat. Ser. No. 07/263 643, filed Oct. 27, 1988, and currently pending.

BACKGROUND OF THE INVENTION

1. Field of the Invention

The present invention relates to a curved pipe manufacturing method and an apparatus for carrying out the same in which a straight pipe of a stainless steel or the like is pressed into a fixed die having a curved cavity of a circular arc to form a curved pipe.

2. Description of the Prior Art

U.S. Pat. No. 4,759,206 discloses a curved pipe manufacturing method employing an apparatus as illustrated in FIG. 6, invented by the inventor of the present invention. According to this known curved pipe manufacturing method and apparatus, a work, namely, a straight pipe 65, is pressed with a presser rod 69 into a curved space, which conforms to the shape of a curved pipe to be formed and is defined by a curved cavity 64 formed in a fixed die 61 so as to extend from the entrance opening 62 to the exit opening 63 of the fixed die 61, and a curved mandrel 67 is secured to a movable block 66 so as to be inserted into and extracted from the curved cavity 64 of the fixed die 61, through the exit opening 63 of the fixed die 61, to form a curved pipe. The movable block 66 is turned to extract only the mandrel 67 from the fixed die 61, and then the movable block 66 is turned further to insert an ejecting rod 68, attached to the movable block 66 opposite to the mandrel 67, into the curved cavity 64 of the fixed die 61, from the entrance opening 62 of the fixed die 61, to thereby push out the curved pipe from the fixed die 61 with the ejecting rod 68, characterized in that, in the middle of pressing the work into the curved space by the pressure rod from the entrance opening 62, the action of presser rod 69 is interrupted in pressing the work 65 into the curved space and the mandrel 67 is removed slightly from a curved portion of the work 65 and then the advancement of the presser rod 69 is restarted to press the work 65 further into the curved space to complete the curved pipe.

However, according to the known method and apparatus, inasmuch as in the middle of manufacturing the curved pipe, there comprises the steps of interrupting the action of presser rod in pressing the work into the curved space and slightly removing the mandrel from a curved portion of the work and then restarting the advancement of the presser rod to press the work further into the curved space to complete the curved pipe, there arises problems that the curved pipe accompanies the mandrel 7 during its removal e.g., the curved pipe is extracted from the exit opening 3 together with the mandrel 7 as well as this process for manufacturing a curved pipe is complicated and the apparatus for carrying out the same is also complicated.

SUMMARY OF THE INVENTION

Accordingly, it is an object of the present invention to provide a curved pipe manufacturing method and an apparatus for carrying out the same which eliminates the foregoing drawback of the known curved pipe manufacturing method and apparatus and is capable of enabling the manufacture of the curved pipe by one step to thereby simplify the manufacturing process and apparatus for carrying out the same.

It is another object of the present invention to provide a curved pipe manufacturing method and an apparatus enabling to extraction of the curved pipe together with the mandrel from the fixed die to thereby facilitate the removal of the curved pipe with ease.

It is a further object of the present invention to provide a manufacturing method and an apparatus for carrying out the same which enables the removal with ease of the curved pipe by pushing out the curved pipe, even if it remains in the fixed die, by an ejecting rod.

It is a still further object of the present invention to provide a manufacturing method and an apparatus for carrying out the same which can be automated with the ease with use of simple sensors to thereby increase the working efficiency remarkably.

It is a still further object of the present invention to provide a manufacturing method and an apparatus for carrying out the same which enables the supplying of a work to a fixed die with ease and presses the work into the fixed die by the arrangement of a movable supporting member at an entrance opening of the fixed die.

To achieve the above objects, the curved pipe manufacturing method of the present invention comprises the steps of: inserting a curved mandrel into a curved cavity of a fixed die, having an entrance opening and an exit opening, through the exit opening, said cavity being formed in a circular arc and extending from the entrance opening to the exit opening thereof, said curved mandrel being attached to one side of a movable block; forming a curved pipe by pressing a work, with a presser rod, through the entrance opening of the curved cavity into a curved space defined by the surface of the curved cavity and the mandrel; turning the movable block and extracting completely the curved pipe together with the mandrel from the exit opening of the curved cavity; inserting a retaining pin into a groove provided in the movable block at the demarcation line between the movable block and the mandrel for retaining a tip end of the curved pipe; and further turning the movable block so as to turn the mandrel while the curved pipe is restricted from movement by the retaining pin so that the curved pipe is separated from the mandrel.

A curved pipe manufacturing apparatus of the present invention comprises: a fixed due having a curved cavity with an entrance opening and an exit opening, said cavity being formed in a circular arc and extending from the entrance opening to the exit opening thereof; a mandrel attached to one side of a movable block and being inserted into the curved cavity of the fixed die through the exit opening; a presser rod for pressing a work into a curved space defined by the surface of the curved cavity and the mandrel to form a curved pipe; and a groove provided at the movable block at the demarcation line between the movable block and the mandrel and capable of receiving a retaining pin, the groove having an upper end flush with an upper surface of the movable block and a lower end flush with the portion extending from a peripheral surface of the mandrel, said retaining pin being insertable into the groove for restraining a tip end of the curved pipe.

The above and other objects, features and advantages of the present invention will become more apparent from the following description taken in conjunction with the accompanying drawings.

DESCRIPTION OF THE PREFERRED EMBODIMENT

Figure 1:
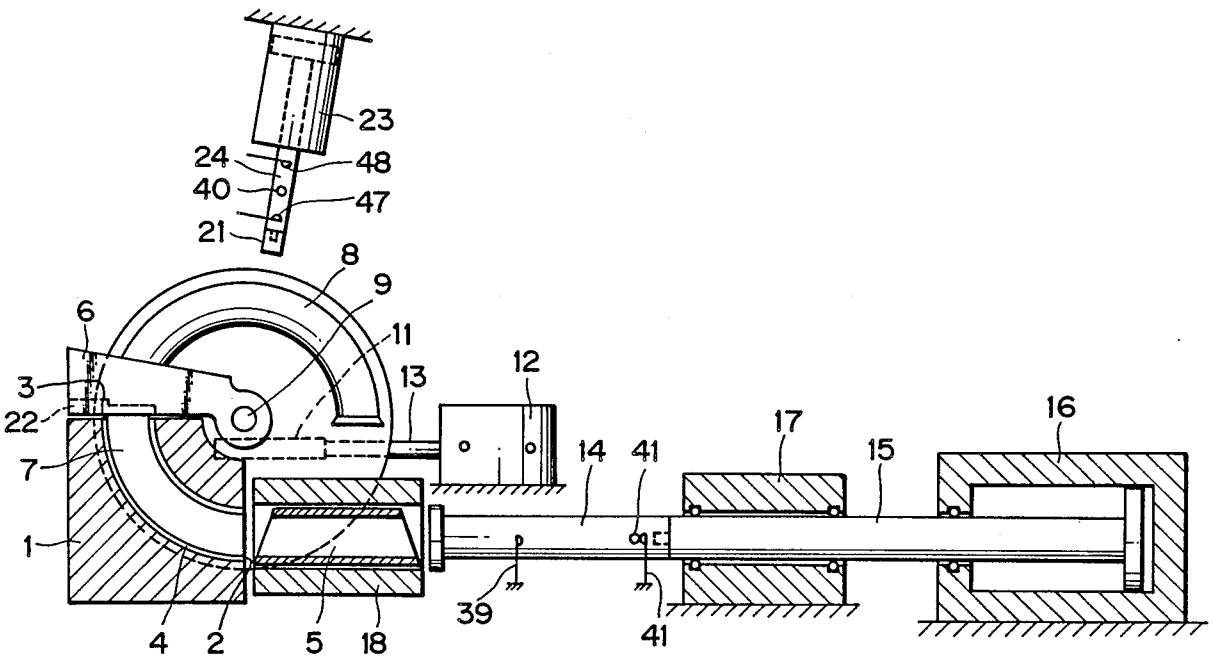
FIG. 1 is a sectional side elevation of a curved pipe manufacturing apparatus, in a preferred embodiment, for carrying out a curved pipe manufacturing method according to the present invention.

A curved pipe manufacturing apparatus, in a preferred embodiment, according to the present invention will be described with reference to FIGS. 1 through 5.

A fixed die 1 has a curved cavity 4, of a circular arc configuration, having an entrance opening 2 and an exit opening 3. The edge of the entrance opening 2 is rounded to facilitate the pressing of a work 5, namely, a straight pipe, into the curved cavity 4. A movable block 6 is provided with a mandrel 7 on one side thereof and an ejecting rod 8 on the other side thereof. The curved cavity 4, the mandrel 7 and the ejecting rod 8 are concentric and respectively have the same curvature. The movable block 6 is fixed to a rotary shaft 9 and can be turned about the rotary shaft 9. The diameter of the mandrel 7 is slightly smaller than the inside diameter of the work 5, while the diameter of the free end of the ejecting rod 8 is practically the same as the outside diameter of the work 5. The diameter of the curved cavity 4 is slightly greater than the outside diameter of the work 5.

Figure 4:
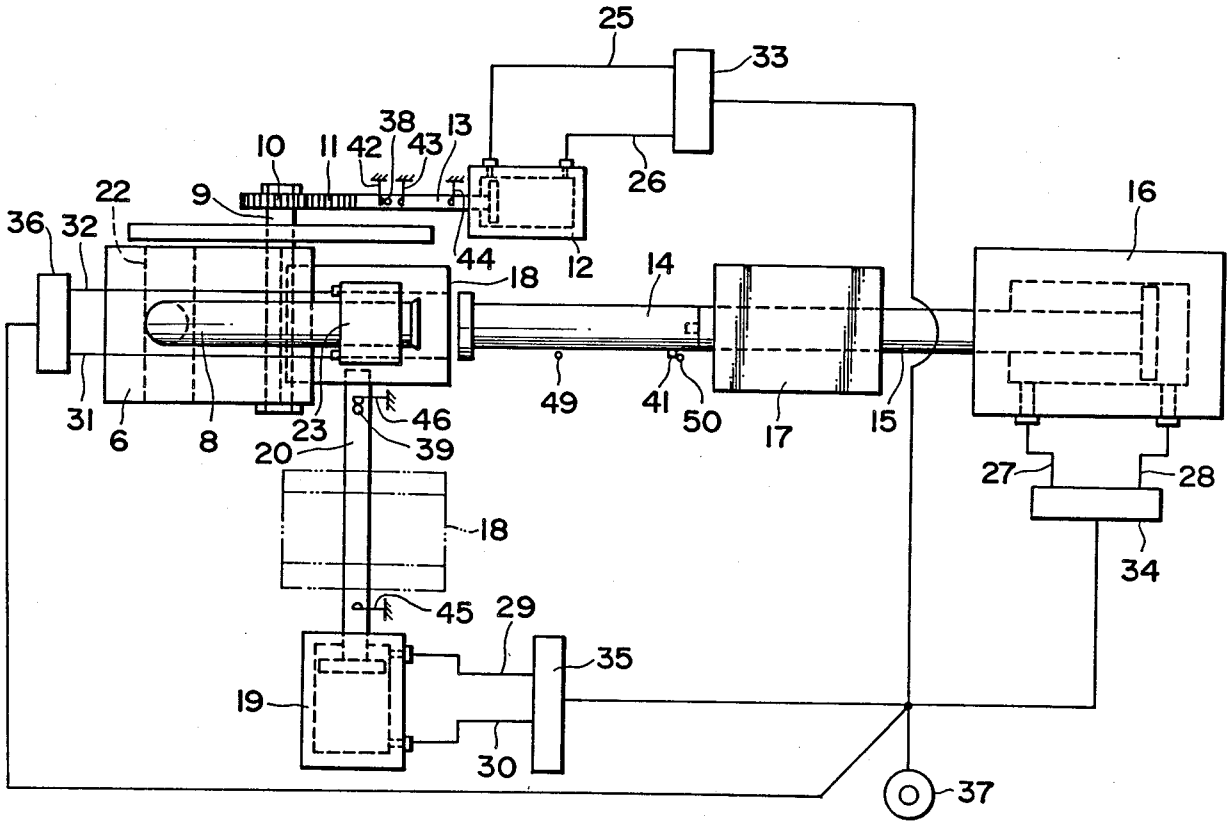
FIG. 4 is a plan view of the curved pipe manufacturing apparatus in FIG. 1.
Figure 5:
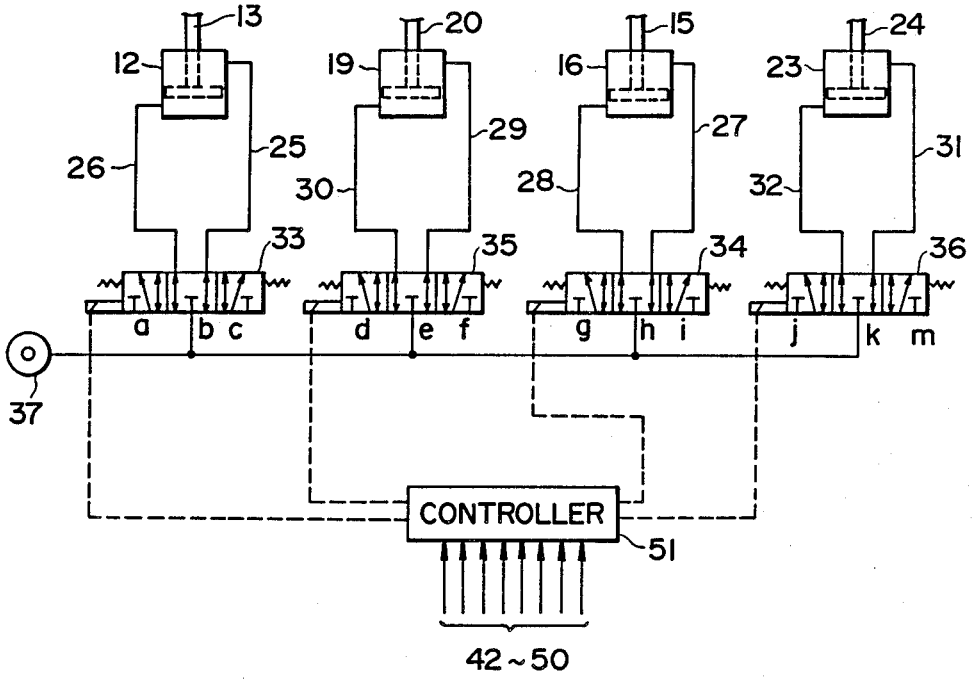
FIG. 5 is a circuit diagram of a controller for controlling the operation of the curved pipe manufacturing apparatus of FIG. 1.
Figure 6:
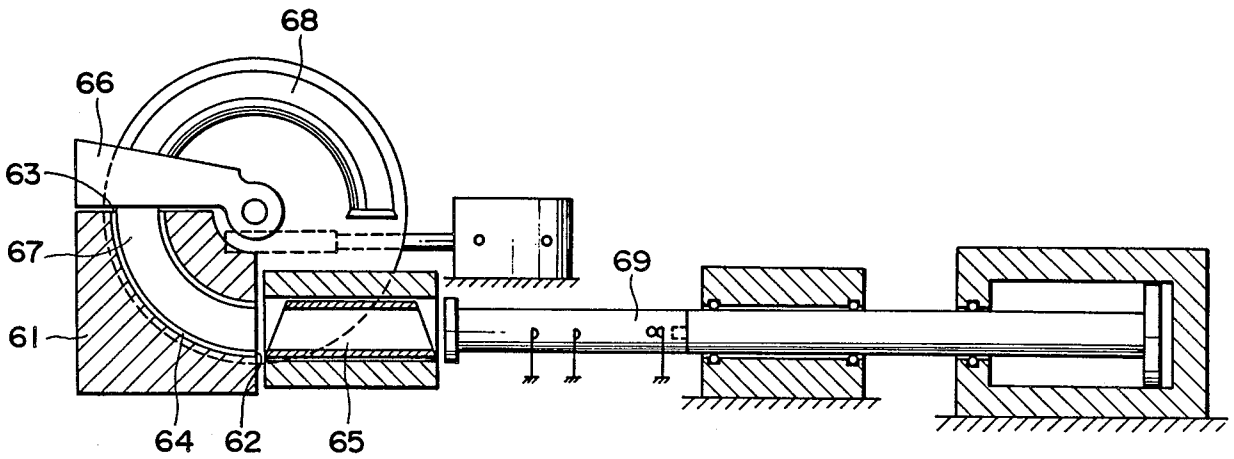
FIG.6 (PRIOR ART)
FIG. 6 is a sectional side elevation view of a prior curved pipe manufacturing apparatus.

As shown in FIG. 4, secured to one end of the rotary shaft 9 is a pinion 10 engaging a rack 11 joined to the free end of the piston rod 13 of a power cylinder 12.

A presser rod 14 for pressing the work 5 into the curved space formed between the surface of the curved cavity 4 of the fixed die 1 and the mandrel 7 has one end screwed in the free end of the piston rod 15 of a power cylinder 16. The presser rod 14 is operated by the power cylinder 16. The diameter of the other end, i.e., the free end, of the presser rod 14 is substantially the same as the outside diameter of the work 5. A guide member 17 is disposed near the front end of the piston rod 15 to support and guide the piston rod 15. The free end of the piston rod 15 extends beyond the guide member 17 on the side of the fixed die 1 and is engaged with the presser rod 14.

A movable pipe supporting member 18 is disposed in front of the entrance opening 2 of the fixed die 1 so as to be moved toward and away from the entrance opening 2 of the fixed die 1 by a piston rod 20 of a power cylinder 19. The movable supporting member 18 is separated from the entrance opening 2 of the fixed die 1 and is located at a receiving position indicated by imaginary lines in FIG. 2, where the work 5 is supplied into the movable supporting member 18.

Figure 2:
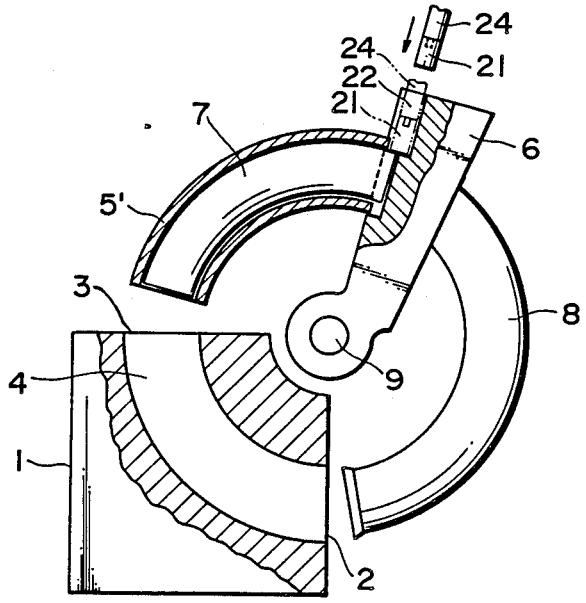
FIG. 2 is a view illustrating the extraction of a curved pipe from the fixed die.
Figure 3:
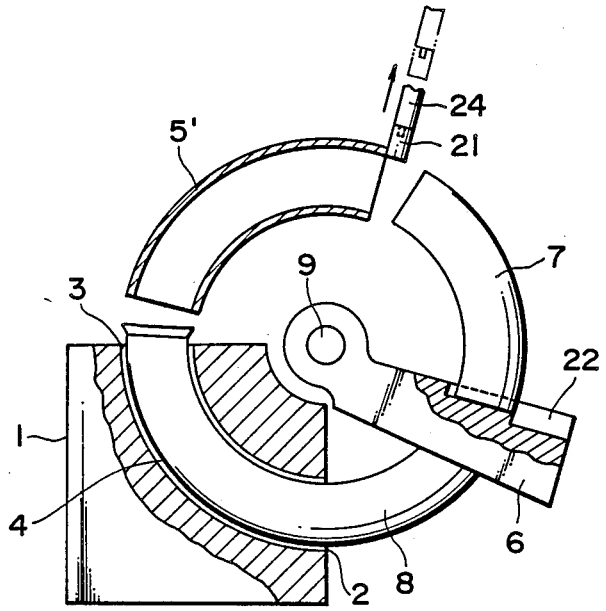
FIG. 3 is a view illustrating the removal of the curved pipe from the mandrel.

The movable block 6 has a groove 22 for receiving a retaining pin 21 at the demarcation line between the movable block 6 and the mandrel 7. The retaining pin 21 is attached to a free end of a piston rod 24 of a power cylinder 23. The groove has an upper end flush with an upper surface of the movable block and a lower end being flush with a peripheral surface of the mandrel. At the spot where the retaining pin 21 is received in the groove 22, the retaining pin 21 restrains the tip end of the curved pipe 5' whereby the retaining pin 21 restrains the turning of the curved pipe 5'(FIG. 2).

Pressurized working fluid supply/return tubes 25 and 26, 27 and 28, 29 and 30, and 31 and 32 are connected to power cylinders 12, 16, 19 and 23, respectively. The pressurized working fluid supply/return tubes 25 and 26, 27 and 28, 29 and 30, and 31 and 32 are connected through selector valves 33, 34, 35 and 36, respectively, to a pressure generating machine such as an air compressor 37.

Projections 38, 39, 40 and 41 are provided on the piston rods 13, 20 and 24 and the pressure rod 14, respectively. The projection 38 actuates sensors 42, 43 and 44; the projection 39 actuates sensors 45 and 46; the projection 40 actuates the sensors 47 and 48; and the projection 41 actuates sensors 49 and 50. When actuated, the sensors sends signals to a controller 51, and then the controller 51 controls the selector valves 33, 34, 35 and 36 to control the operations of the power cylinders 12, 16, 19 and 23 according to the signals given thereto.

When the movable supporting member 18 is located at the receiving position indicated by imaginary line in FIG. 4, where the movable supporting member 18 receives the work 5, the mandrel 7 is located in place in the curved cavity 4 of the fixed die 1.

When actuated, the sensor 42 gives a signal to set the selector valve 33 at a position b, and the selector valve 35 at a position d to the controller 51. Consequently, the supply of working fluid to the power cylinder 12 is interrupted to stop the advance of the piston rod 13; the working fluid is supplied through the tube 30 into the rear chamber of the powder cylinder 19; the working fluid is exhausted through the tube 29 from the front chamber of the power cylinder 19 to advance the piston rod 20 to move the movable supporting member 18 supporting the work 5 to a position immediately before the entrance opening 2 of the fixed die 1. The projection 39 of the piston rod 20 actuates the sensor 46. Then, the sensor 46 gives a signal to set the selector valve 35 at a position e, and the selector valve 34 at a position g to the controller 51. Consequently, the supply of working fluid to the power cylinder 19 is interrupted to stop the advancing motion of the piston rod 20; the working fluid is supplied through the tube 28 into the rear chamber of the power cylinder 16 and the working fluid is exhausted from the front chamber of the power cylinder 16 through the tube 27 to advance the piston rod 15, and thereby the work 5 supported on the movable supporting member 18 is pressed into the curved space formed between the inner surface of the fixed die 1 and the mandrel 7 through the entrance opening 2 by the tip end of the presser rod 14.

As the work 5 is pressed into the fixed die 1 by the presser rod 14, the work 5 is gradually bent in a circular arc. In proportion to the force of bending applied to the work 5, the force of contact between the work 5 and the mandrel 7 is increased. After the work 5 has been pressed into the fixed die 1 in substantially the entire length thereof, the projection 41 of the presser rod 14 actuates the sensor 49. Then, the sensor 49 gives a signal to set the selector valve 34 at a position i to the controller 51. Consequently, the working fluid is supplied through the tube 27 to the front chamber of the power cylinder 16 and the working fluid is exhausted from the rear chamber of the power cylinder 16 through the tube 28 to retract the piston rod 15 slightly, whereby the presser rod 14 is returned to a position remote from the fixed die 1, and the projection 41 actuates the sensor 50. Then, the sensor 50 given a signal to set the selector valve 34 at the position h and the selector valve 35 to the position f to the controller 51. Consequently, supply of the working fluid to the power cylinder 16 is interrupted to stop the retracting motion of the piston rod 15; the working fluid is supplied through the tube 29 into the front chamber of the power cylinder 19 and the working fluid is exhausted from the rear chamber of the power cylinder 19 through the tube 30 to retract the piston rod 20, whereby the movable supporting member 18 is returned to its starting position. The projection 39 actuates the sensor 45 by the retracting motion of the piston rod 20.

The sensor 45 gives a signal to set the selector valve 35 at the position e, and the selector valve 33 at the position c to the controller 51. Consequently, the supply of working fluid to the power cylinder 19 is interrupted to stop the retracting motion of the piston rod 20; the working fluid is supplied through the tube 25 to the rear chamber of the powder cylinder 12 and the working fluid is exhausted from the front chamber of the power cylinder 12 through the tube 26, so that the piston rod 13 is retracted and the rotary shaft 9 is turned with the rack 11 engaging the pinion 10, whereby the movable block 6 is turned away from the fixed die 1. As the movable block 6 is turned, the mandrel 7, together with the processed curved pipe 5', are pulled out from the exit opening 3 of the fixed die 1. With the retracting motion of the piston rod 13, the projection 38 actuates the sensor 43. At this state, the curved pipe 5' and the mandrel 7 are extracted from the exit opening 3 of the fixed die 1 (At the state in FIG. 2).

Whereupon, the sensor 43 gives a signal to set the selector valve 27 at the position b, and the selector valve 36 at the position j to the controller 51. Consequently, working fluid is supplied through the tube 32 to the rear chamber of the power cylinder 23 and the working fluid is exhausted from the front chamber of the power cylinder 23 through the tube 31, so that the piston rod 24 advances while the movement of the movable block 6 is temporarily interrupted. As the piston rod 24 advances, the retaining pin 21 is inserted into the groove 22 for receiving the retaining pin 21 whereby the tip end of the curved pipe 5' is contacted by the retaining pin 21 (At the state illustrated in imaginary lines in FIG. 2). At this retaining state, the projection 40 actuates the sensor 47. Then, the sensor 47 gives a signal to set the selector valve 36 at a position k and the selector valve 33 at a position c to the controller 51. Consequently, the working fluid is supplied through the tube 25 into the front chamber of the power cylinder 12 and the working fluid is exhausted from the rear chamber of the power cylinder 12 through the tube 26 to retract the piston rod 13, whereby the rotary shaft 9 is turned with the rack 11 engaging the pinion 10 to turn the movable block 6 away from the fixed die 1.

When the movable block 6 is turned, the mandrel 7 is turned together with the movable block 6, however, the turning of the curved pipe 5' is restricted since the tip end thereof 5' is restrained by the retaining pin 21. Accordingly, the curved pipe 5' is removed from the mandrel 7 as the movable block 6 is further turned. At the point where the curved pipe 5' is removed completely from the mandrel 7 (FIG. 3), the projection 38 actuates the sensor 44.

The sensor 44 gives a signal to set the selector valve 36 at the position m and the selector valve 33 at the position a to the controller 51. Consequently, the working fluid is supplied through the tube 31 into the front chamber of the power cylinder 23 and the working fluid is exhausted from the rear chamber of the power cylinder 23 through the tube 32 to retract the piston rod 24 while the working fluid is supplied through the tube 26 to the rear chamber of the power cylinder 12 and the working fluid is exhausted from the front chamber of the power cylinder 12 through the tube 25 to advance the piston rod 13. Accordingly, as the retaining pin 21 is retracted and the piston rod 13 is advanced, the rotary shaft 9 is turned with the rack 11 engaging the pinion 10 to turn the movable block 6 to move toward the fixed die 1. As the movable block 6 is thus turned, the mandrel 7 is gradually inserted into the cavity 4 of the fixed die 1.

Upon the complete insertion of the mandrel 7 into the curved cavity 4, the projection 38 actuates the sensor 42. Then, the sensor 42 gives a signal to set the selector valve 33 at the position b, and the selector valve 35 at the position d to the controller 51. Consequently, the supply of working fluid to the power cylinder 12 is interrupted to stop the advancing motion of the piston rod 13; the working fluid is supplied through the tube 30 into the rear chamber of the power cylinder 19, and the working fluid is exhausted from the front chamber of the power cylinder 19 through the tube 29 to advance the piston rod 20, whereby the movable pipe supporting member 18 holding the work is moved again towards the entrance opening 2 of the fixed die 1 by the piston rod 20.

A series of the foregoing actions is repeated to effect successively the pipe bending process automatically. The work 5 is supplied to the movable pipe supporting member 18 while the movable pipe supporting member 18 is positioned to be away from the fixed die 1 as illustrated in the imaginary lines of FIG. 4.

During a series of processes for manufacturing the curved pipe 5', if it happens that the curved pipe 5' remains in the curved cavity 4 when the mandrel 7 is extracted from the curved cavity 4 of the fixed die 1. The ejecting rod 8, which is turned together with the movable block 6, can press the rear end of the curved pipe 5' whereby the curved pipe 5' can be extracted from the curved cavity 4 of the fixed die 1.

To subject a work 5 having a different outside diameter and inside diameter to the pipe bending process, another mandrel 7 having a diameter corresponding to the inside diameter of the work 5 and another ejecting rod 8 having a diameter corresponding to the outside diameter of the work 5 are attached to the movable block 6; the fixed die 1 is replaced by another fixed die 1 having a curved cavity 4 corresponding to the external shape of a curved pipe to be formed; another presser rod 14 having a diameter corresponding to the outside diameter of the work 5 is screwed in the free end of the piston rod 15; another movable supporting member 18 suitable for supporting the new work 5 is connected to the piston rod 20.

The working fluid may be a hydraulic oil or compressed air. The pressure generating machine is an oil pump or an air compressor.

Although the invention has been described as applying to a horizontal curved pipe manufacturing apparatus, the present invention is not limited thereto in its application, the present invention is applicable also to a vertical curved pipe manufacturing apparatus.

Although the invention has been described in its preferred form with a certain degree of particularity, it is to be understood that many variations and changes are possible in the invention without departing from the scope and spirit thereof.

What is claimed is:

1. A curved pipe manufacturing method comprising the steps of:

(1) providing a fixed die having a curved cavity, an entrance opening and an exit opening contained therein, said curved cavity being formed in a circular arc and extending from said entrance opening to said exit opening;

(b 2) providing a movable block having a curved mandrel attached to one side thereof;

(3) inserting the curved mandrel into the curved cavity of the fixed die through the exit opening therein and forming a curved annular chamber inside said cavity;

(4) pressing a work with a presser rod through said entrance opening into said curved annular chamber to form a curved pipe;

(5) moving the movable block so as to extract the mandrel and the curved pipe from said exit opening;

(6) inserting a retaining pin into a groove provided in the movable block for restraining a tip end of the curved pipe;

(7) further moving the movable block so as to extract the mandrel and the curved pipe from said exit opening, said curved pipe being restrained from movement by said retaining pin; and (8) recovering said curved pipe.

2. A curved pipe manufacturing method according to claim 1, additionally comprising the steps of;

providing an ejecting rod on a side of said movable block opposite to said curved mandrel; and inserting said ejecting rod into said entrance opening so as to contact the other tip end of said curved pipe and help eject said curved pipe from said curved cavity.

3. A curved pipe manufacturing apparatus comprising:

a fixed die having a curved cavity, an entrance opening and an exit opening contained therein, said curved cavity being formed in a circular arc and extending from said entrance opening to said exit opening;

a movable block having a curved mandrel attached to one side thereof and a groove provided therein, said groove having an upper end flush with an upper surface of the movable block and a lower end flush with a peripheral surface of said curved mandrel, said groove being capable of receiving a retaining pin and said movable block being mounted for circular movement so as to insert said curved mandrel into the exit opening of said fixed die to form a curved annular chamber therein and to remove said curved mandrel from said exit opening;

a presser rod for pressing a work into said curved annular chamber to form a curved pipe; and a retainer pin mounted for reciprocating movement into and out of said groove, said retainer pin restraining said curved pipe from movement when inserted into said groove.

4. A curved pipe manufacturing apparatus as recited in claim 3, further comprising an ejecting rod attached to a side of said movable block opposite to said curved mandrel and capable of movement into said entrance opening of said fixed die during said circular movement of said movable block so as to eject said curved pipe through said exit opening of said fixed die; and a controller means for regulating a driving mechanism for said retainer pin so that said curved pipe may be restrained and separated from said mandrel during the removal of said mandrel from said exit opening.

* * * * *